United States Patent [19]

Fallier, Jr. et al.

[11] Patent Number: 4,680,509

[45] Date of Patent: Jul. 14, 1987

[54] METHOD AND APPARATUS FOR STARTING HIGH INTENSITY DISCHARGE LAMPS

[75] Inventors: Charles N. Fallier, Jr., Westford; James N. Lester, Rockport, both of Mass.

[73] Assignees: GTE Laboratories, Inc., Waltham; GTE Products Corporation, Danvers, both of Mass.

[21] Appl. No.: 812,577

[22] Filed: Dec. 23, 1985

[51] Int. Cl.[4] ..... H05B 37/00

[52] U.S. Cl. ..... 315/290; 315/39; 315/241 R; 315/244; 307/110

[58] Field of Search ..... 315/39, 54, 76, 244, 315/249, 289, 241 R, 290; 307/157, 110

[56] References Cited

U.S. PATENT DOCUMENTS

| | | | |
|---|---|---|---|
| 2,521,513 | 9/1956 | Gray | 315/244 |
| 3,322,976 | 5/1967 | Blank | 307/110 |
| 4,005,336 | 1/1977 | Casella | 315/239 |
| 4,327,311 | 4/1982 | Wroblewski | 315/244 |
| 4,353,012 | 10/1982 | Fallier et al. | 315/241 R |

*Primary Examiner*—Harold Dixon

*Attorney, Agent, or Firm*—Jose W. Jimenez; Edward J. Coleman

[57] ABSTRACT

A light source including a spiral line pulse generator having an output coupled to one electrode of a high pressure discharge lamp and having an input for coupling to a source of lamp operating power for providing high voltage lamp starting pulses. The pulse generator includes, in addition to a spiral line circuit, a solid state electronic switch for discharging the spiral line pulse generator and a ballast capacitor connected in series with the solid state switch. The spiral line pulse generator preferably has a magnetic core associated therewith for increasing the spiral line inductance.

21 Claims, 4 Drawing Figures

METHOD AND APPARATUS FOR STARTING HIGH INTENSITY DISCHARGE LAMPS

REFERENCE TO COPENDING APPLICATION

In copending Application Ser. No. 812537, entitled "High Frequency Lamp Ignitor" (James Lester) and filed Dec. 23, 1985, there is defined a spiral line starter circuit, for HID lamps, having an inductor added in series with a sidac.

TECHNICAL FIELD

The present invention relates in general to the starting of high intensity discharge lamps and pertains, more particularly, to a new and improved lamp igniter apparatus utilizing a spiral line pulse generator. The lamp igniter apparatus provides high voltage, short duration pulses for starting high intensity discharge lamps.

BACKGROUND OF THE INVENTION

A spiral line pulse generator is disclosed by R. A. Fitch, et al in U.S. Pat. No. 3,289,015, issued Nov. 29, 1966. The generator is a device capable of storing electrical energy and, upon momentary short circuiting of a pair of terminals associated with the device, of providing a high amplitude pulse. The spiral line pulse generator, when properly utilized, provides the dual function of energy storage and voltage multiplication. The spiral line pulse generator is a transient field reversal device that provides an approximately triangular pulse. Its peak voltage is a multiple of the initial charging voltage. The construction of the spiral line is such that the voltage from the beginning to the end of the line adds through vector inversion producing a very high voltage pulse.

Some arc discharge lamps are known to be particularly difficult to start. One example of such a lamp is an arc lamp containing a sodium amalgam and a noble gas such as xenon at a relatively high pressure, such as 500 Torr. Another example of a difficult lamp to start is a metal halide lamp which requires a higher starting voltage than is available from an AC voltage line, of a wide range of voltages, with the use of a simple ballast.

The use of a spiral line pulse generator to start high pressure sodium lamps is disclosed in U.S. Pat. No. 4,325,004 to J. M. Proud, et al issued Apr. 13, 1982 and assigned to the assignee of the present application. In this patent, the output of the spiral line pulse generator is coupled to a conductor or starting aid, located in close proximity to an outer surface of the discharge tube. In the case of metal halide lamps, it has been found undesirable to locate conductors in close proximity to the central portion of the discharge tube, thereby ruling out the use of a starting aid to assist in initiating discharge in metal halide lamps.

U.S. Pat. No. 4,353,012 to C. N. Fallier, Jr. et al, issued Oct. 5, 1982, and also assigned to the assignee of the present application, shows a starting circuit for high intensity discharge metal halide lamps which comprises a spiral line pulse generator including two conductors and two insulators, each in the form of an elongated sheet, constructed in an alternating and overlapping arrangement which is rolled together in a spiral configuration having a plurality of turns. The spiral line pulse generator includes an output terminal coupled to one of the electrodes of the lamp and a pair of input terminals. One of the input terminals and the other of the electrodes of the lamp are adapted for coupling to a source of lamp operating power for delivering lamp operating power, received from the source, through the spiral line pulse generator to the discharge lamp. The starting circuit includes a spark gap and series resistor for applying a voltage between the conductors of the spiral line pulse generator and for switching the generator from a first voltage to a second voltge in a time interval much shorter than the transit time of electromagnetic waves through the spiral line pulse generator. After operation of the spark gap switch, the spiral line pulse generator provides, at its output terminal, a high voltage, short duration pulse of sufficient energy to initiate discharge in the discharge lamp.

While the starting circuit described in U.S. Pat. No. 4,353,012 is suitable for the purposes intended, its performance could be improved substantially if greater output voltage could be applied to the lamp electrodes, producing a higher starting voltage and, thus, more reliable lamp starting.

SUMMARY OF THE INVENTION

Accordingly, it is an object of the present invention to provide a new and improved apparatus for the starting of high intensity discharge lamps that are normally difficult to start, such as high pressure sodium lamps containing noble gases or metal halide lamps.

Another object of the present invention is to provide an improved lamp igniter circuit that has decreased starting power, particularly in comparison with existing circuits.

Another object of the present invention is to provide an improved lamp igniter circuit having increased peak voltage output and a circuit in which the placement of components comprising the circuit and lead lengths between components is less critical than with existing circuits.

A further object of the present invention is to provide an improved lamp igniter circuit that operates so as to transfer optimum energy to the discharge lamp while utilizing smaller component parts, thus making the overall starter circuit more compact.

According to the invention, there is provided a light source that comprises a high pressure discharge lamp and a pulse generator means. The high pressure discharge lamp includes a discharge tube having electrodes sealed therein and enclosing a fill material which emits light during discharge. The pulse generator means includes a spiral line pulse generator having two conductors and two insulators, each in the form of an elongated sheet, in an alternating and overlapping arrangement which is rolled together in a spiral configuration having a plurality of turns. The spiral line pulse generator includes an output terminal coupled to one of the electrodes of the lamp and also a pair of input terminals. One of the input terminals and the other one of the electrodes of the discharge lamp are adapted for coupling to a source of lamp operating power. The spiral line pulse generator preferably has associated therewith, a ferromagnetic core means for increasing the spirial line inductance. The pulse generator means also includes a solid state electronic switch means having a breakdown voltage greater than the lamp operating voltage and furthermore having a low turn-on (conducting) voltage. The switch means is coupled between the conductors of the spiral line generator and arranged to short circuit the conductors. Finally, the pulse generator means includes a circuit return means coupled from one of the conductors of the spiral line to the other of the lamp electrodes. The spiral line pulse generator, after operation of the electronic switch means, provides at its output, a high voltage, short duration pulse of sufficient energy to initiate discharge in the high pressure discharge lamp.

Still another aspect of the invention is a method for starting a high pressure discharge lamp of the type including a discharge tube having electrodes sealed therein for receiving AC power from a lamp ballast and enclosing a fill material which emits light during discharge. The method comprises the steps of applying the AC source power between two conductors of a spiral line pulse generator including said two conductors and two insulators, each in the form of an elongated sheet, in an alternating and overlapping arrangement which is rolled together in a spiral configuration having a plurality of turns, the spiral line pulse generator further including an output taken between an innermost turn and an outermost turn of the spiral configuration; and increasing the spiral line inductance by providing the pulse generator with ferromagnetic core means. The method further includes short circuiting the conductors of the pulse generator by providing an electronic switch means between the conductors; and coupling circuit return means from one of the conductors of the generator to the other of the lamp electrodes, whereby the high voltage, short duration pulse initiates discharge in the high pressure discharge lamp.

BEST MODE OF CARRYING OUT THE INVENTION

For a better understanding of the present invention, together with other and further objects, advantages and capabilities thereof, reference is made to the following disclosure and appended Claims in connection with the above described drawings.

Figure 1:
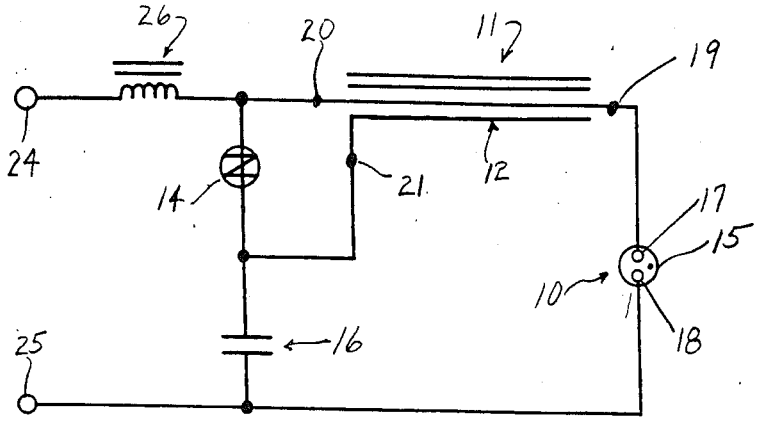
FIG. 1 is a schematic diagram of an improved spiral line starter circuit and light source in accordance with the teachings of the invention.

A high intensity light source starter circuit in accordance with the teachings of the present invention is shown in schematic form in FIG. 1 comprising a high pressure discharge lamp 10, a spiral line pulse generator 12, a solid state electronic switch 14, and ballast capacitor 16. Discharge lamp 10 is a high intensity metal halide discharge lamp which comprises a discharge tube 15 having electrodes 17 and 18 sealed therein. Spiral line pulse generator 12 includes an output terminal 19 which is coupled to electrode 17 of discharge lamp 10. Solid state electronic switch 14 is coupled across a pair of input terminals 20 and 21 of spiral line pulse generator 12.

At the input to the circuit of FIG. 1, there is provided an input AC voltage impressed at the terminals 24 and 25. This input value may have a peak-to-peak AC voltge of 277 volts at 60 Hertz. The source of lamp operating power also includes a ballast 26 which couples one of input terminals 24 to one of input terminals 20 of the spiral line pulse generator 12. Ballast capacitor 16 is coupled between input terminal 21 of spiral line pulse generator 12 and electrode 18 of discharge lamp 10.

Spiral line pulse generator 12 is charged through the capacitor 16 and, after closure of the solid state electronic switch 14, provides at its output a high voltage, short duration pulse which initiates discharge in discharge lamp 10.

The charge path for spiral line pulse generator 12 includes input ballast 26 coupling from the input AC line; the charging of the spiral line pulse generator continuing until the breakdown voltage of solid state switch 14 is reached. When switch 14 turns on, spiral line pulse generator 12 discharges through solid state switch 14 causing the high voltage spiral line pulse to appear at lamp 10. The input line current through ballast 26 then divert through the switch 14 maintaining it in a conductive state until the input current drops below the holding current level of switch 14. This occurs when the line voltage nears zero volts. In this way, a single pulse therefor occurs per half cycle of the line voltage. The current drawn through switch 14 and spiral line pulse generator 12 is returned through capacitor 16 to the neutral power line noted at terminal 25.

Discharge lamp 10 is a conventional high intensity discharge metal halide lamp in which no starting aid is included. Discharge tube 15 is typically fused silica and can contain a noble gas at low pressure and various volatile fill materials including mercury and one or more metal halides, typically metal iodides. The discharge current flows between electrodes 17 and 18 after discharge has been initiated by the high voltage pulse.

Figure 2:
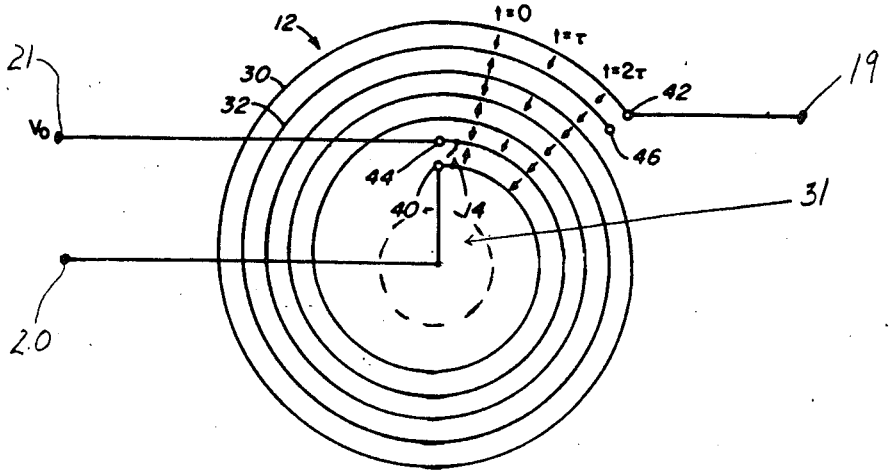
FIG. 2 is a simplified schematic diagram of a spiral line pulse generator.
Figure 3:
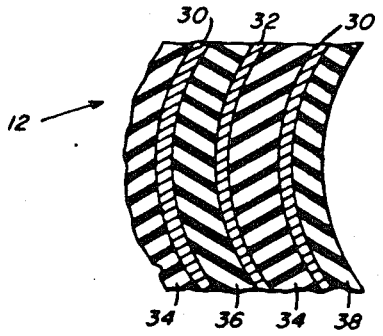
FIG. 3 is a partial cross-sectional view of the spiral line pulse generator shown in FIG. 2.

Spiral line pulse generator 12 is shown in simplified form in FIG. 2 for ease of understanding. A pair of conductors 30 and 32 in the form of elongated sheets of conductive material are rolled together to form a multiple turn spiral configuration. FIG. 3 is a partial cross-sectional view of spiral line pulse generator 12 illustrating the layered construction of the device. A four-layered arrangement of alternating conductors and insulators, including the conductors 30 and 32 and a pair of insulators 34 and 36, is rolled onto a form 38 in a multiple turn spiral configuration, form 38 providing mechanical rigidity. Conductors 30 and 32 are separated by dielectric material at every point in the spiral configuration.

The operation of spiral line pulse generator 12 can be described with reference to FIG. 2, which schematically shows conductors 30 and 32. Conductor 30 runs from point 40 to point 42 while conductor 32 runs from point 44 to point 46. In the present example, switch 14 is coupled between conductors 30 and 32 at or near the points 40 and 44. A voltage is applied between the conductors 30 and 32. Prior to the closing of switch 14, conductor 30 has a uniform potential between points 40 and 42 and conductor 32 has a uniform potential between points 44 and 46. The voltage difference between the innermost and the outermost turns of the spiral configuration is at most $2nV_o$. This can be seen by summing the electric field vectors at time $t=0$ as shown in FIG. 2. When switch 14 is rapidly closed, a field reversing wave propagates along the transmission line formed by the conductors 30 and 32. When the wave reaches points 42 and 46, at time $t=\tau$, the potential difference between the points 42 and 40 is $nV_o$, where n is the number of turns in the spiral configuration, due to the absence of cancelling static field vectors. As is well known, the propagating wave undergoes an in-phase reflection at the points 42 and 46 when these points are terminated in a high impedance or are open circuited as shown in FIG. 2. This results in an additional increase in the potential difference between the innermost and outermost conductors with a maximum occurring at time $t=2\tau$ at which time the field vectors are aligned as shown in FIG. 2. The output taken between point 42 or 46 and point 40 reaches a maximum voltage of $2nV_o$ at $t=2\tau$ after the closure of switch 14. The operation of the spiral line pulse generator is described in further detail in U.S. Pat. No. 3,289,015 and in Fitch et al, "Novel Principle of Transient High Voltage Generation," Proc. IEE, Vol. 111, No. 4, April 1964.

Reference is also made herein to U.S. Pat. No. 4,353,012 to C. N. Fallier, Jr., et al that provides further details of the spiral line construction, characteristics, and related parameters and equations. U.S. Pat. No. 4,353,012 describes a spiral line pulse circuit that utilizes a spark gap as the switch along with a ballast resistor. On the other hand, in accordance with the teachings of the present invention in the diagram of FIG. 1 of the present application, the resistor is replaced by a ballast capacitor and the spark gap is replaced by a solid state electronic switch. Moreover, the addition of a ferrite magnetic core to the spiral line construction increases the distributed spiral line inductance which permits the use of a solid state electronic switch that is characterized by a slow turn-on. Furthermore, the addition of a ferrite magnetic core to the spiral line construction makes the spiral line pulse generator less sensitive to circuit parasitic inductances thus making it possible to use longer wires in connecting the switch in the circuit. The substitution of a ballast capacitor for the ballast resistor limits the starter current and eliminates $I^2R$ losses inherent in the resistive ballast.

There are a number of advantages achieved by the circuit of the present invention as exemplified in FIG. 1. For example, the starter power is decreased substantially. In one typical example, the starter power is decreased by an order of magnitude from 30 watts to 3 watts. Because of this low power consumption, the starting circuit can run continuously without having dissipation problems. In this regard, in the circuit described in U.S. Pat. No. 4,353,012 employing a ballast resistor, it was typical to use an underrated resistor because a resistor necessary to handle the full 30 watts of starter power would be too large to package in the base of the lamp. As a result, the resistor tended to burn up if the starter was run very long. In addition, the large conducting voltage drop of the spark gap caused the spark gap to run hot during continuous operation. The spark gap provided proper starting performance for only about 15 seconds before it became too hot. Even when remoted, the original starter still had to dissipate 30 watts and could not be easily mounted in a fixture without expensive and bulky heat sinking. With the present invention, these heat dissipation problems are overcome and furthermore the parts that are employed are substantially smaller allowing for a more compact starter circuit.

Figure 4:
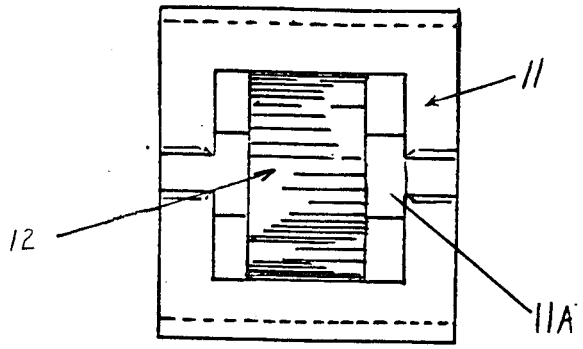
FIG. 4 illustrates the spiral line pulse generator wound on a magnetic core.

As indicated previously, a ferrite magnetic core has been added to the spiral line construction. This is illustrated schematically by the dotted outline of a ferromagnetic core 31 in FIG. 2. In this regard, reference is also made to FIG. 4 which illustrates spiral line pulse generator 12 as wound upon a closed loop ferrite magnetic core 11. In FIG. 4 the ferrite core is of the "doule E" type having a substantially cylindrical center core segment 11A. In its simplest form, the ferrite magnetic core may be a ferrite rod. However, it is preferred to have the core formed in a closed loop such as in the version of FIG. 4. The magnetic core may also be made of any other magnetic material and need not be limited to ferrites.

As also indicated previously, the ferrite magnetic core increases the distributed spiral line inductance. The use of the ferromagnetic core utilizes the spiral line winding more efficiently so as to achieve a voltage step-up that is more proportional to the number of turns in the spiral line pulse generator. Thus, the use of the core in conjunction with the spiral line allows the use of a slower switching device in place of the previously used spark gap. The slower switching device in accordance with the invention may be a solid state electronic switch such as a sidac. Such as device may have a breakdown voltage in one examle of 240 volts with a low conducting voltage drop thereacross. The breakdown voltage is selected to be greater than the lamp operating voltage, once started, so that the sidac is essentially out of the circuit after the lamp has been started.

The solid state electronic switch, such as as sidac, has a relatively low "on" voltage drop whereby more energy is transferred to the lamp 10 from spiral line generator 12 in comparison to the prior circuits that employed a spark gap switch. In one example, the "on" voltage of the solid state electronic switch is on the order of 1.0 volt in comparison with a voltage of 30 volts for the spark gap switch. In addition, the peak spiral line output voltage is increased by 20% with the use of the solid state switch and ballast capacitor due to the reduced circuit losses previously associated with the ballast resistor and spark gap.

With respect to the use of a ferromagnetic material in association with a spiral line circuit, Fitch, et al makes mention in the article "Novel Principle of Transient High Voltage Generation," proceedings of the Institute of Electrical Engineers, Vol. III, No. 4, April, 1964, that the size of the spiral generator may be reduced by using a ferromagnetic core. In this article they also indicate that the use of a ferromagnetic core introduces insulation complications with no suggestion of methods to overcome this problem. It is furthermore noted that they are relating this teaching to high power spiral line generators with outputs exceeding 100 KV.

Moreover, Criswell et al, in U.S. Pat. No. 3,681,604, issued Aug. 1, 1972 on a portable X-ray generating machine, mentions the use of a core with a high magnetic permeability to increase spiral line power output. However, this patent does not teach the use of a material with a high magnetic permeability to increase output pulse voltage. This patent also relates to a spiral line generator with an output pulse of at least 100 KV. The starter circuit in that patent also makes no reference to the combined teachings of the ferrite core with a solid state switch. In this regard, in accordance with the present invention, there is used a spiral line generator with the addition of a ferromagnetic core to increase the magnitude of the magnetic field within the core area and adapted for use as an automatic starting device with standard ballasts to start discharge lamps.

With a ferromagnetic core as illustrated in FIG. 4, the pulse output of the spiral line generator may be increased substantially as will be discussed and noted further in connection with Table I. It is furthermore noted that this pulse does not discharge into the ballast to initiate a high voltate pulse and is, therefore, suitable for use with conventional ballasts without regard to voltage breakdown.

Furthermore, the addition of the ferrite core increases the spiral line distributed inductance which reduces the sensitivity of the spiral line circuit to external switching device closure and opening times. The increased spiral line inductance also permits the use of longer circuit leads making the placement of components less critical than in a circuit such as described in U.S. Pat. No. 4,353,012. In the circuit described in that patent, lead lengths had to be generally under an inch while in accordance with the improved circuit of this invention the device operates with lead lengths of 8 inches or more. In this regard, reference is made to Table I herein which provides a comparison of spiral line circuits showing different components used, including circuits with and without the ferromagnetic core and including switches that are either in the form of a spark gap or solid state switch. Reference to Table I will be made in further detail hereinafter.

With the use of the preferred solid state switch, it has been found that the switch remains conducting long enough for the spiral line to discharge so that an optimum amount of energy is transferred to the lamp. In addition, the conducting solid state switch inhibits the occurrence of high voltage pulses at the output of ballast 26 or on the power line. This inhibiting characteristic is similar to that of a spark gap, but occurs at a lower voltage due to the lower "on" state voltage drop of the solid state switch or sidac.

As indicated previously, it is preferred to provide ballast capacitor 16 for a numer of reasons in addition to reduction in power dissipation. The ballast capacitor also functions as a high frequency (pulse) shunt to the lamp return, effectively making the starter circuit a parallel injection circuit further allowing maximum pulse energy transfer to the lamp and minimum voltage induction back to the power line and input ballast. In this regard, it is noted that the pulse circuit described in U.S. Pat. No. 4,353,012 was of the series injection type and required that the ballast and line function as the return path to the lamp.

The ballast capacitor also functions as an energy storage device which discharges into the lamp 10 through the spiral line circuit during starting enhancing the breakdown of the lamp. A ballast capacitor of one microfarad stores 0.1 Joule while the spiral line stores approximately 0.003 Joule. The peak voltage across the ballast capacitor is greater than the peak of the line voltage due to a resonant effect between the lamp ballast inductance 26 and the ballast capacitor 16. The closer this resonance occurs to 60 Hertz, the higher the capacitor voltage. This means that more starting voltage and stored capacitor energy can be supplied to the discharge lamp 10. Moreover, capacitor 16 charges quickly when sidac 14 is conducting causing the voltage across capacitor 16 to appear more as a square wave than a sine wave. This action effectively lengthens the time of peak applied starting (low voltage) voltage to the lamp further enhancing lamp starting.

TABLE I

| | | | | Comparison of Spiral Line Circuits | | | | | | |
|---|---|---|---|---|---|---|---|---|---|---|
| Core | Switch | Switch Lead Length (in) | Ballast | Peak Pulse Voltage (KV) | First Pulse Width (Micro Sec) | Second Pulse Width (Micro Sec) | Peak 60 HZ Out (V) | Output Wave Shape | Power In (W) | Current (A) |
| N | SG | ¾ | R | 2.2 | 0.2 | 0.1 | 424 | Sine | 30 | 0.11 |
| N | SG | 6 | R | 0.73 | 0.2 | 0.05 | 424 | Sine | 30 | 0.11 |
| N | SD | 1 | R or C | 0.71 | 0.2 | 0.3 | — | Sine | — | — |
| Y | SD | 4 | C | 7.2 | 1.0 | 2.5 | 456 | Square | 3 | 0.2 |
| Y | SD | 8 | C | 6.7 | 1.0 | 2.5 | 456 | Square | 3 | 0.2 |

Notes:
N = no
Y = yes
SG = 230 V Spark Gap
SD = 240 V Sidac
R = 2 Kohm
C = 1 MFD
Spiral line capacitance = 0.1 MFD Reference has been made to Table I hereinbefore. This table shows a number of different categories including circuits with and without the ferromagnetic core. The first two categories employ a spark gap, while the latter three categories use a solid state switch. It is noted that with the use of a core and a solid state switch, switch lead lengths can extend to 8 inches or more without any difficulty. Furthermore, with the use of the capacitor ballast rather than the resistor more without any difficulty. Furthermore, with the use of the capacitor ballast rather than the resistor ballast, there is noted a dramatic increase in peak pulse voltage output. Also noted in the input power which is decreased by an order of magnitude with the use of a capacitor ballast rather than the resistor ballast.

While there has been shown and described what is at present considered the preferred embodiment of the invention, it should be obvious to those skilled in the art that various changes and modifications may be made therein without departing from the scope of the invention as defined by the appended Claims.

What is claimed is:

1. Apparatus for starting a high pressure discharge lamp of the type including a discharge tube having a pair of electrodes sealed therein and enclosing a fill material which emits light during discharge, said apparatus comprising:

a spiral line pulse generator including two conductors and two insulators, each in the form of an elongated sheet, in an alternating and overlapping arrangement which is rolled together in a spiral configuration having a plurality of turns for forming an electromagnetic wave transmission line during operation;

a ferromagnetic core means disposed in relation to said spiral configuration for increasing the distributed inductance of said spiral line generator, and thereby increasing the electromagnetic wave transit time in the transmission line formed by the spiral line generator;

said spiral line pulse generator including an output terminal coupled to one of said lamp electrodes and a pair of input terminals, one of said input terminals and another of the lamp electrodes being adapted for coupling to a source of AC lamp operating power;

a switch means coupled across said input terminals, and thus between the conductors of the spiral line generator for periodically short-circuiting said conductors during operation;

and pulse circuit return means coupled from the other of the input terminals of said spiral line generator to said last mentioned lamp electrode;

whereby said spiral line generator, upon application of a source of AC lamp operating power and periodic operation of said switch means, provides at said pulse output, high voltage, short duration pulses of sufficient energy to initiate discharge in said high pressue discharge lamp.

2. Apparatus as set forth in claim 1 wherein said high pressure discharge lamp comprises a high pressure sodium lamp including a noble gas.

3. Apparatus as set forth in claim 1 wherein said high pressure discharge lamp comprises a metal halide discharge lamp.

4. Apparatus as set forth in claim 1 wherein said switch means is a solid state electronic switch means.

5. Apparatus as set forth in claim 4 wherein said solid state electronic switch means comprises a sidac.

6. Apparatus as set forth in claim 4 wherein said solid state electronic switch means has a turn-on voltage on the order of about one volt.

7. Apparatus as set forth in claim 4 wherein said solid state electronic switch means has a breakdown voltage greater than the lamp operating voltage, once the lamp is started.

8. Apparatus as set forth in claim 7 wherein said switch breakdown voltage is on the order of about 240 volts for a 100 watt lamp.

9. Apparatus as set forth in claim 1 wherein said circuit returns means comprises a capacitor.

10. Apparatus as set forth in claim 9 wherein said capacitor has a value in the range of about 1–4 microfarads.

11. Apparatus as set forth in claim 1 further including ballast means coupled from said source of lamp operating power to said one input terminal of said spiral line pulse generator.

12. Apparatus as set forth in claim 1 wherein said magnetic core means comprises an enclosed loop core.

13. Apparatus as set forth in claim 12 wherein said core has a segment passing through said spiral line pulse generator turns.

14. A method for starting a high pressure discharge lamp of the type including a discharge tube having electrodes sealed therein and enclosing a fill material which emits light during discharge, said method comprising the steps of:

applying a source of AC power across two conductors of a spiral line pulse generator including said two conductors and two insulators, each in the form of an elongated sheet in an alternating and overlapping arrangement which is rolled together in a spiral configuration having a plurality of turns for forming an electromagnetic wave transmission line during operation, said spiral line generator providing during operation a pulse output across an innermost turn and an outermost turn of said spiral configuration, the outermost turn being coupled to one of said lamp electrodes;

increasing the distributed inductance of the spiral line generator, and thereby increasing electromagnetic wave transit time in the transmission line thereof, by providing said spiral line generator with magnetic core means;

periodically short-circuiting the conductors of said spiral line pulse generator by providing a switch means between the conductors thereof;

and coupling circuit return means from one of the conductors of said spiral line generator to another said lamp electrodes, whereby said periodic short-circuiting of the spiral line conductors during application of AC power generates high voltage, short duration pulses from said spiral line pulse output for initiating discharge in said high pressure discharge lamp.

15. A method as set forth in claim 14 wherein said switch means is a solid state electronic switch means.

16. A method as set forth in claim 15 wherein said solid state electronic switch means comprises a sidac.

17. A method as set forth in claim 14 wherein said high pressure discharge lamp comprises a metal halide discharge lamp.

18. A method as set forth in claim 14 wherein said circuit return means comprises a capacitor.

19. A method as set forth in claim 14 which further includes coupling a ballast means from said source of lamp operating power to said one input terminal of said spiral line pulse generator.

20. A method as set forth in claim 14 wherein said magnetic core means comprises an enclosed loop core.

21. A method as set forth in claim 20 wherein said core has a segment passing through said spiral line pulse generator turns.

* * * * *